US011733641B2

(12) United States Patent
Son

(10) Patent No.: US 11,733,641 B2
(45) Date of Patent: Aug. 22, 2023

(54) IMAGE FORMING APPARATUS INCLUDING SWINGABLE DEVELOPMENT HOLDER

(71) Applicant: KYOCERA Document Solutions Inc., Osaka (JP)

(72) Inventor: Geki Son, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/807,541

(22) Filed: Jun. 17, 2022

(65) Prior Publication Data

US 2022/0404760 A1 Dec. 22, 2022

(30) Foreign Application Priority Data

Jun. 22, 2021 (JP) ..... 2021-103399

(51) Int. Cl.
*G03G 21/16* (2006.01)
*G03G 21/18* (2006.01)

(52) U.S. Cl.
CPC ..... *G03G 21/1647* (2013.01); *G03G 21/1633* (2013.01); *G03G 21/1676* (2013.01); *G03G 21/1821* (2013.01); *G03G 2221/1869* (2013.01)

(58) Field of Classification Search
CPC ..... G03G 21/1633; G03G 21/1647; G03G 21/1676; G03G 21/1817; G03G 21/1821; G03G 21/1839; G03G 2221/1869; G03G 15/08; G03G 15/751; G03G 21/1604
See application file for complete search history.

(56) References Cited

U.S. PATENT DOCUMENTS

| | | | | |
|---|---|---|---|---|
| 10,915,059 | B2 | 2/2021 | Ohashi | |
| 2013/0183062 | A1* | 7/2013 | Lee | G03G 21/1647 399/110 |
| 2017/0261918 | A1* | 9/2017 | Zensai | G03G 21/1633 |
| 2019/0196392 | A1* | 6/2019 | Katsumata | G03G 21/1821 |
| 2020/0310339 | A1* | 10/2020 | Yokoi | G03G 21/1676 |
| 2020/0356023 | A1* | 11/2020 | Sakaguchi | G03G 15/6508 |

FOREIGN PATENT DOCUMENTS

JP 2020-201459 A 12/2020

* cited by examiner

*Primary Examiner* — Sophia S Chen
(74) *Attorney, Agent, or Firm* — Studebaker & Brackett PC

(57) ABSTRACT

An image forming apparatus includes a drum unit, a developing device, a development holder, and a sliding member. The drum unit includes a photosensitive drum. The developing device includes a developing roller. The development holder is swung so as to bring and separate the developing roller close to and apart from the photosensitive drum. The sliding member is slidable in an axial direction of the developing roller. The development holder is swung so as to bring the developing roller close to the photosensitive drum in association with a sliding of the sliding member from a first position to a second position, and the development holder is swung so as to separate the developing roller apart from the photosensitive drum in association with a sliding of the sliding member from the second position to the first position.

8 Claims, 11 Drawing Sheets

IMAGE FORMING APPARATUS INCLUDING SWINGABLE DEVELOPMENT HOLDER

INCORPORATION BY REFERENCE

This application is based on and claims the benefit of priority from Japanese patent application No. 2021-103399 filed on Jun. 22, 2021, which is incorporated by reference in its entirety.

BACKGROUND

The present disclosure relates to an image forming apparatus.

An electrophotographic type image forming apparatus is provided with a photosensitive drum and a developing device. The photosensitive drum is required to be replaced when it reaches the life end. The developing device requires periodic maintenance. Therefore, the photosensitive drum and the developing device may be generally configured to be detachably attached to the apparatus main body individually. For example, the image forming apparatus may be provided with a unit support frame to which a drum unit and a developing device are detachably attached individually, and a development holder provided in the unit support frame which holds the developing device in an swingable manner in a direction for bringing and separating the developing roller close to and apparat from the photosensitive drum, and the development holder includes a driving gear for transmitting power to the developing device, and a pair of swinging shaft portions having a rotational axis extending in parallel with the axis direction of the developing roller and rotatably supported to the unit support frame.

However, since the above image forming apparatus is provided with a cam for swinging the developing device and a gear for interlocking the opening/closing of a cover with the operation of the cam, the number of components increases and the cost increases.

SUMMARY

In accordance with one aspect of the present disclosure, an image forming apparatus includes a drum unit, a developing device, a development holder, and a sliding member. The drum unit includes a photosensitive drum. The developing device includes a developing roller disposed such that its outer circumferential surface faces an outer circumferential surface of the photosensitive drum. To the development holder, the developing device is detachably attached. The development holder is swung so as to bring and separate the developing roller close to and apart from the photosensitive drum. The sliding member is slidable in an axial direction of the developing roller. The development holder is swung so as to bring the developing roller close to the photosensitive drum in association with a sliding of the sliding member from a first position to a second position, and the development holder is swung so as to separate the developing roller apart from the photosensitive drum in association with a sliding of the sliding member from the second position to the first position.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the drawings, an image forming apparatus 100 according to one embodiment of the present disclosure will be described.

Figure 1:
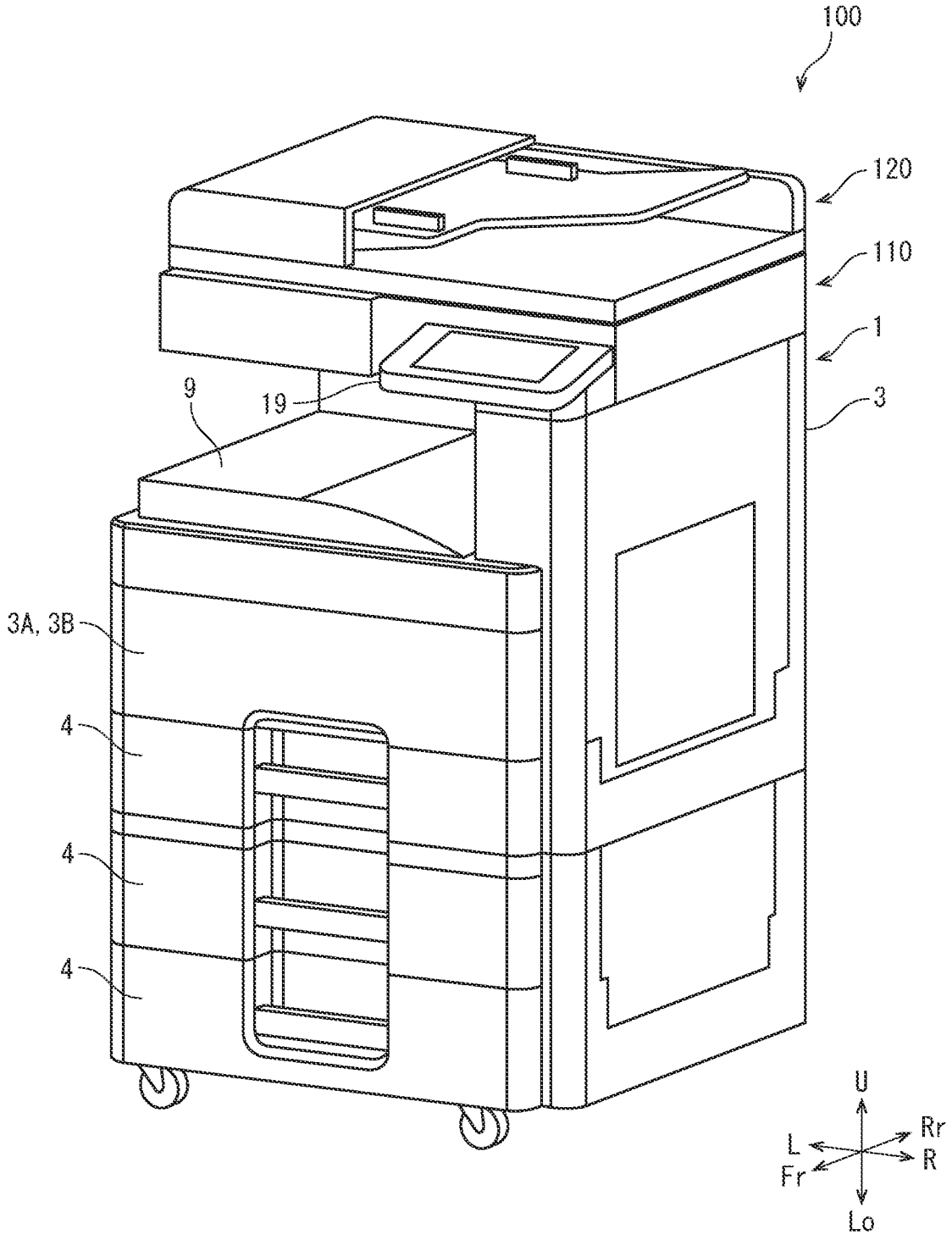
FIG. 1 is a perspective view showing an external appearance of an image forming apparatus according to one embodiment of the present disclosure.
Figure 2:
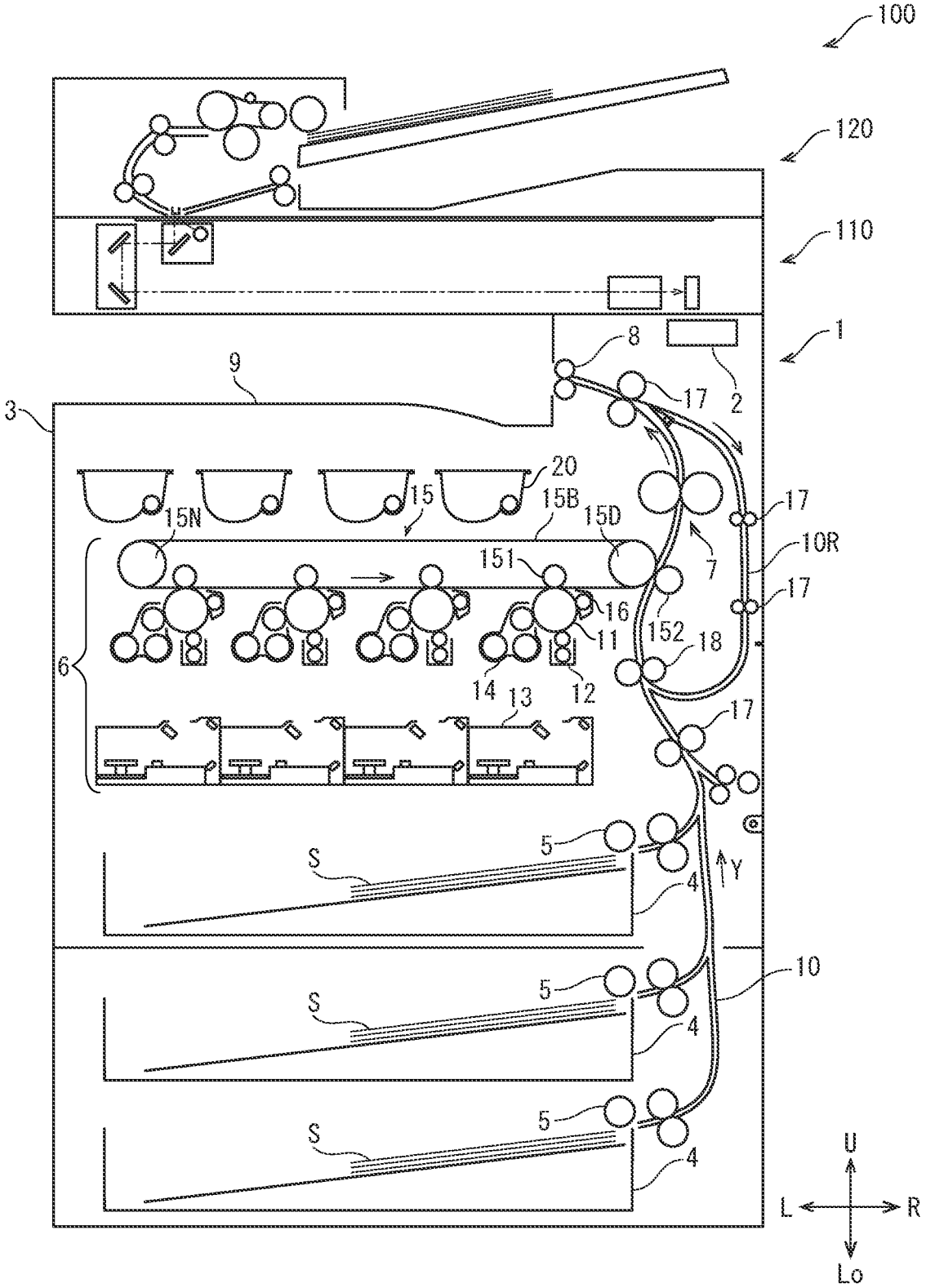
FIG. 2 is a front view schematically showing an inner structure of the image forming apparatus according to the embodiment of the present disclosure.

First, the entire structure of the image forming apparatus 100 will be described. FIG. 1 is a perspective view showing an external appearance of the image forming apparatus 100. FIG. 2 is a front view schematically showing an inner structure of the image forming apparatus 100. Hereinafter, the front side of the sheet surface on which FIG. 2 is drawn will be referred to as the front side of the image forming apparatus 100, and the left-and-right direction will be described with reference to the direction in which the image forming apparatus 100 is viewed from the front side. In each of the drawings, U, Lo, L, R, Fr and Rr indicate an upper, a lower, a left, a right, a front, and a rear, respectively.

The image forming apparatus 100 includes a printer 1, a scanner 110 and a document conveying device 120. The scanner 110 is provided above the printer 1, and the document conveying device 120 is provided above the scanner 110. The document conveying device 120 conveys a document along a conveyance path passing through a reading position of the scanner 110. The scanner 110 is a flatbed type image scanner, and reads the document to generate image data. The printer 1 forms an image based on the image data on a sheet S.

The printer 1 and the scanner 110 are integrated by a housing 3. In the lower portion of the inside of the housing 3, a sheet feeding cassette 4 in which the sheet S is stored and a sheet feeding roller 5 which feeds the sheet S rightward from the sheet feeding cassette 4 are provided. Above the sheet feeding cassette 4, an image forming device 6 which forms a toner image by an electrophotographic method is provided. On the upper and right side of the image forming device 6, a fixing device 7 which fixes the toner image to the sheet S is provided. Above the fixing device 7, a sheet discharge roller 8 which discharges the sheet S on which the toner image is fixed and a sheet discharge tray 9 on which the discharged sheet S is stacked are provided.

Inside the housing 3, a conveyance path 10 is provided from the sheet feeding roller 5 to the sheet discharge roller 8 via the image forming device 6 and the fixing device 7. The conveyance path 10 is formed mainly of plate-like members facing each other with a gap through which the sheet S is passed, and conveying rollers 17 which holds and conveys the sheet S are provided at a plurality of positions in the conveyance direction Y. A registration roller 18 is provided on the upstream side of the image forming device 6 in the conveyance direction Y. An inversion conveyance path 10R branching from the conveyance path 10 on the downstream side of the fixing device 7 in the conveyance direction Y and merging with the conveyance path 10 on the upstream side of the registration roller 18 in the conveyance direction Y is provided on the right side of the fixing device 7.

The image forming device 6 includes a photosensitive drum 11 whose potential is changed by irradiation with light, a charging device 12 which charges the photosensitive drum 11, an exposure device 13 which emits laser light according to the image data, a developing device 14 which supplies toner to the photosensitive drum 11, an intermediate transfer unit 15 which transfers the toner image from the photosensitive drum 11 to the sheet S, and a cleaning device 16 which removes the toner remaining on the photosensitive drum 11. The intermediate transfer unit 15 includes an endless intermediate transfer belt 15B stretched around a driving roller 15D and a driven roller 15N, primary transfer rollers 151 which face the inner circumference surface of the intermediate transfer belt 15B at positions corresponding to the photosensitive drums 11 and generate a primary transfer bias, and a secondary transfer roller 152 which faces the outer circumference surface of the intermediate transfer belt 15B at a position corresponding to the driving roller 15D and generates a secondary transfer bias. A toner container 20 which supplies the toner to the developing device 14 is connected to each developing device 14.

The image forming device 6 includes four sets of the photosensitive drum 11, the charging device 12, the exposure device 13, the developing device 14, the primary transfer roller 151, the cleaning device 16, and the toner container 20, and forms a color image by overlapping the toner images of four colors on an intermediate transfer belt 15B. The present disclosure may be applied to an image forming apparatus that forms a color image with toners of three or less colors, or five or more colors.

The controller 2 includes an arithmetic part and a storage part. The arithmetic part is a CPU (Central Processing Unit), for example. The storage part includes a storage medium such as ROM (Read Only Memory), RAM (Random Access Memory) and EEPROM (Electrically Erasable Programmable Read Only Memory). The arithmetic part reads, executes the control program stored in the storage part, and performs various processing. The controller 2 may be implemented by an integrated circuit without using software.

An operation panel 19 is provided on the front side of the scanner 110. The operation panel 19 includes a display panel, a touch panel overlapped on the display surface of the display panel, and a keypad adjacent to the display panel. The controller 2 displays a screen indicating an operation menu, a status and the others of the printer 1 and the scanner 110 on the display panel, and controls each part of the printer 1 and the scanner 110 according to an operation detected by the touch panel and the keypad.

The basic image forming operation of the printer 1 is as follows. When a single-side printing job is input to the printer 1 from an external computer or the like, the sheet feeding roller 5 feeds the sheet S from the sheet feeding cassette 4 to the conveyance path 10, the registration roller 18 whose rotation is stopped corrects the skew of the sheet S, and the registration roller 18 feeds the sheet S to the image forming device 6 at a predetermined timing. In the image forming device 6, the charging device 12 charges the photosensitive drum 11 to a predetermined potential, the exposure device 13 writes an electrostatic latent image on the photosensitive drum 11, the developing device 14 develops the electrostatic latent image by using the toner supplied from the toner container 20 to form a toner image, the primary transfer roller 151 transfers the toner image to the intermediate transfer belt 15B, and the secondary transfer roller 152 transfers the toner image to the sheet S. Subsequently, the fixing device 7 melts the toner image and fixes it to the sheet S while holding and conveying the sheet S, and the sheet discharge roller 8 discharges the sheet S to the sheet discharge tray 9. The cleaning device 16 removes the toner remaining on the photosensitive drum 11. In the case of double-side printing, the sheet S having the toner image fixed on one surface of the sheet S is fed to the conveyance path 10 via the inversion conveyance path 10R, whereby the toner image is transferred to the other surface of the sheet S.

Figure 3:
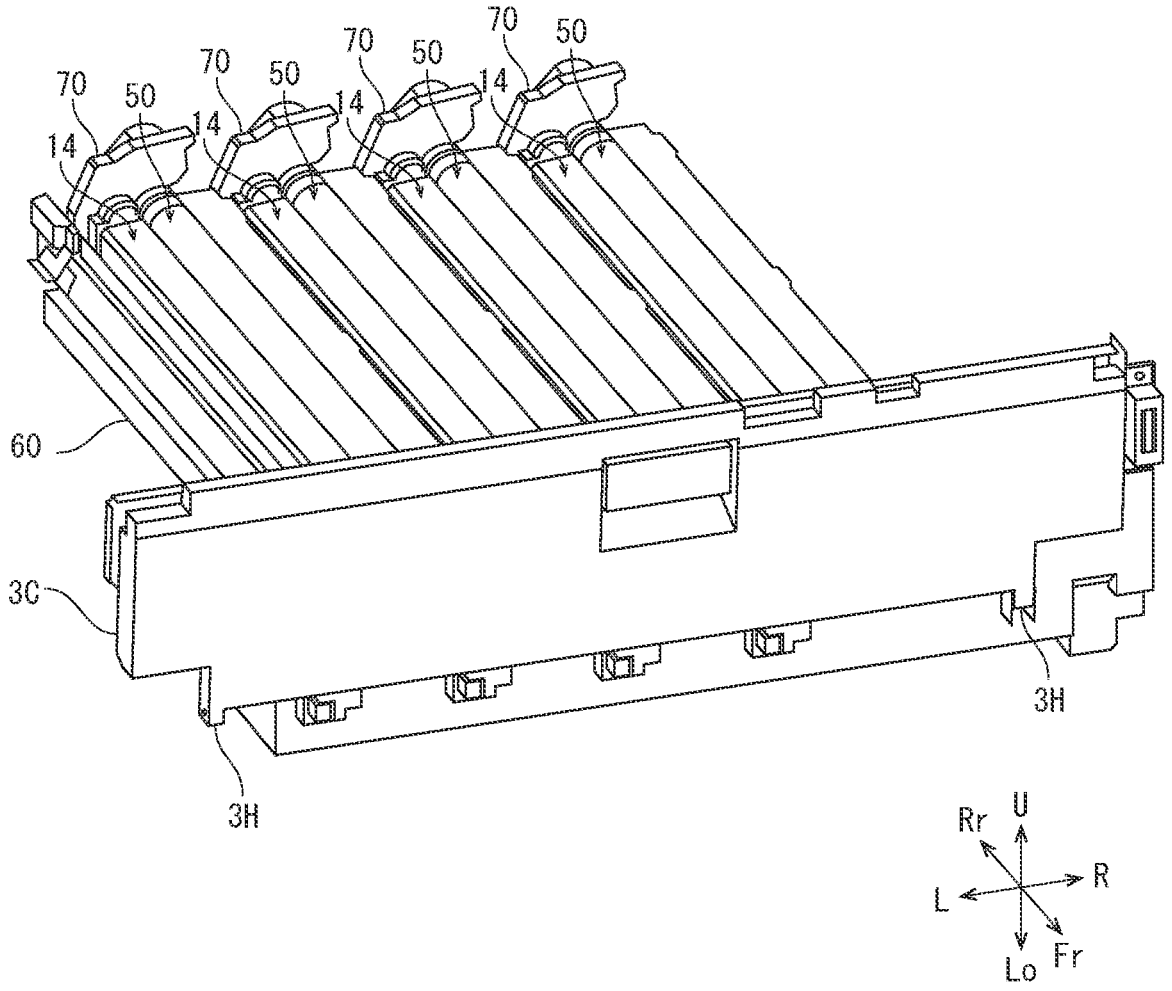
FIG. 3 is a perspective view showing an image forming device and an inner cover according to the embodiment of the present disclosure.
Figure 4:
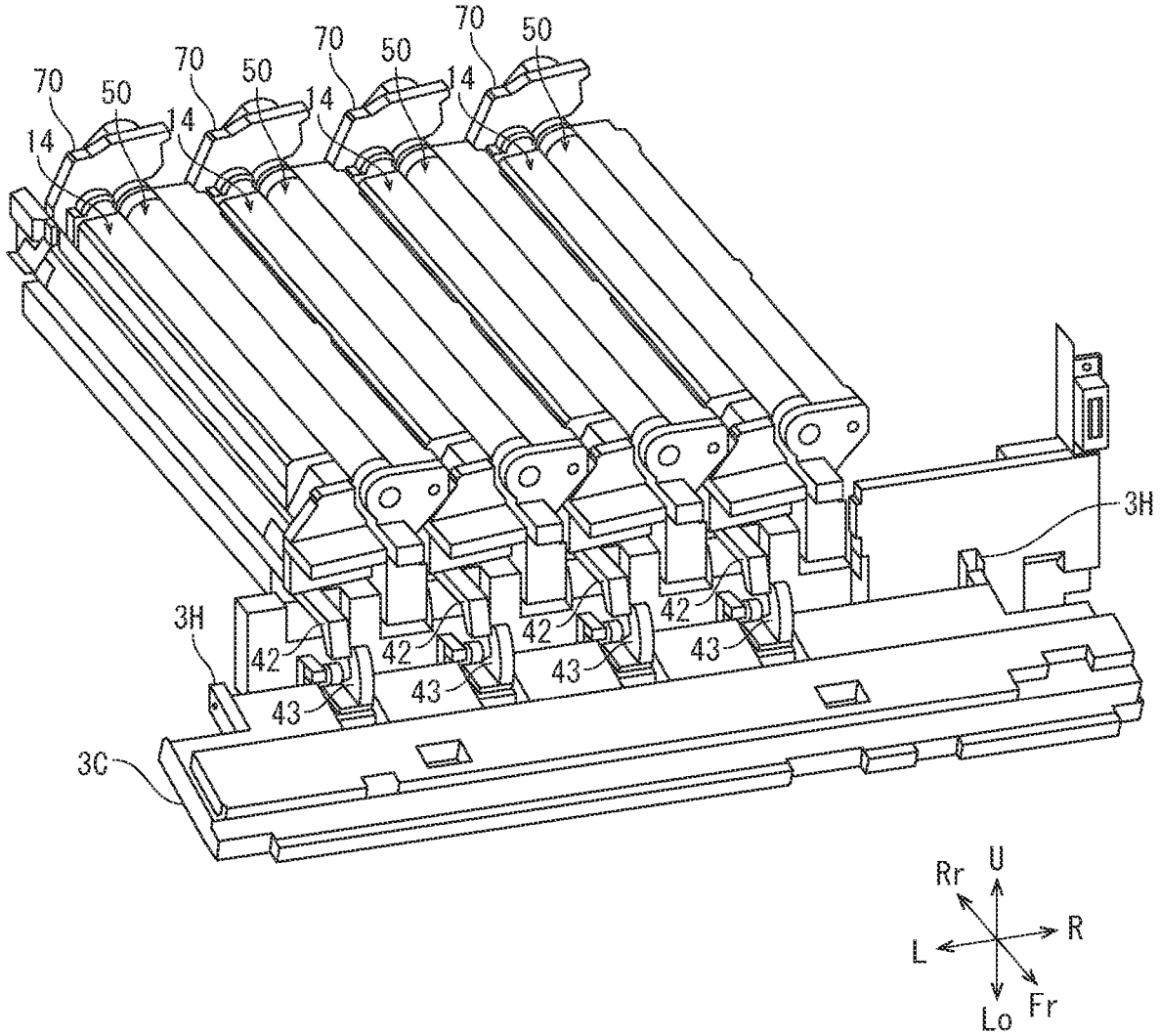
FIG. 4 is a perspective view showing the image forming device and the inner cover according to the embodiment of the present disclosure.
Figure 5:
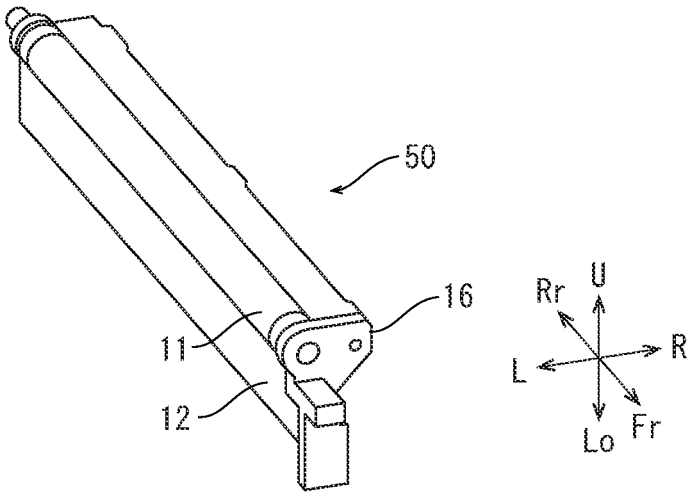
FIG. 5 is a perspective view showing a drum unit according to the embodiment of the present disclosure.
Figure 6:
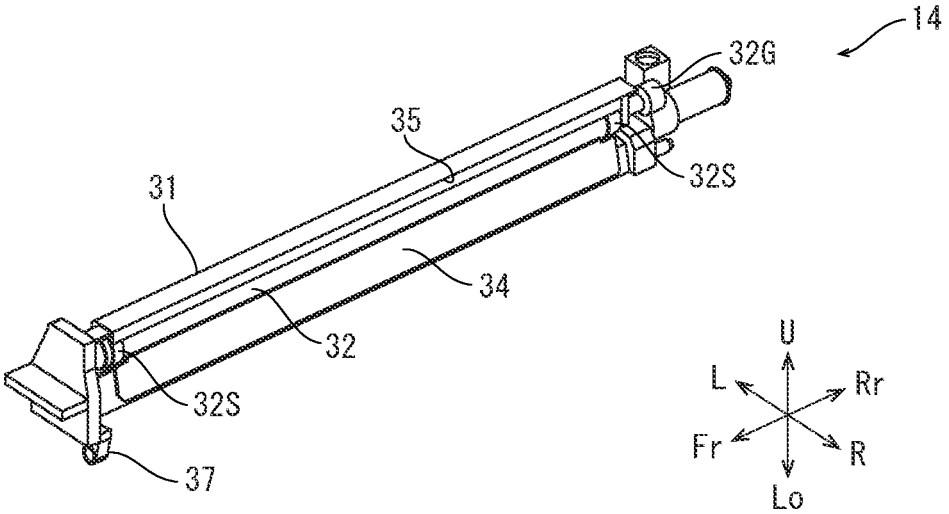
FIG. 6 is a perspective view showing a developing device according to the embodiment of the present disclosure.
Figure 7:
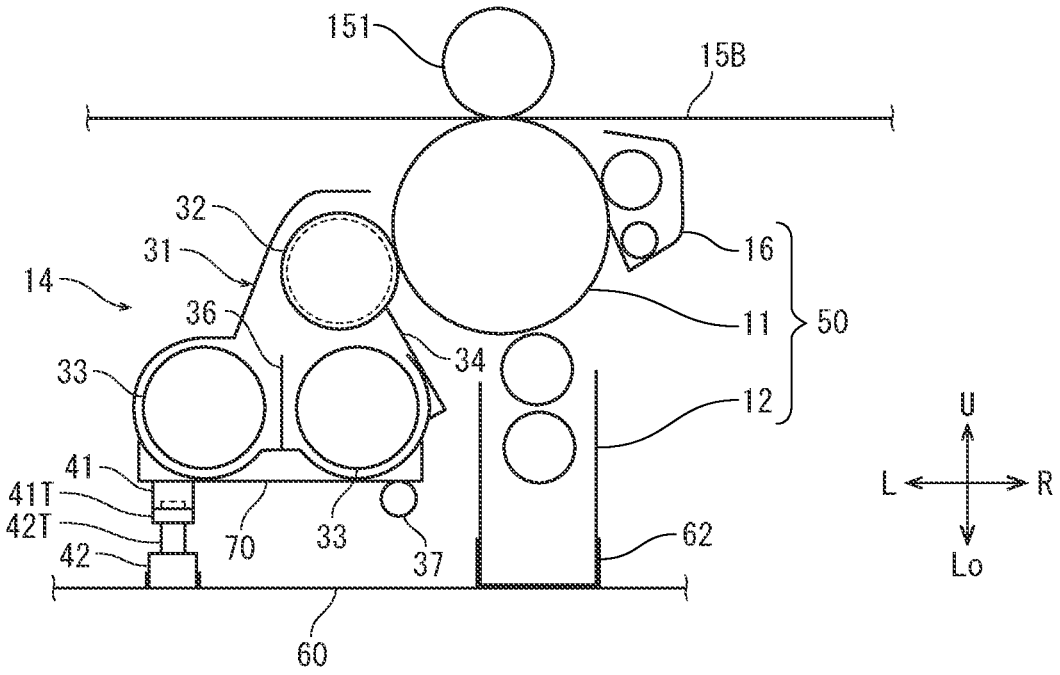
FIG. 7 is a front view schematically showing a structure of the image forming device according to the embodiment of the present disclosure.
Figure 8:
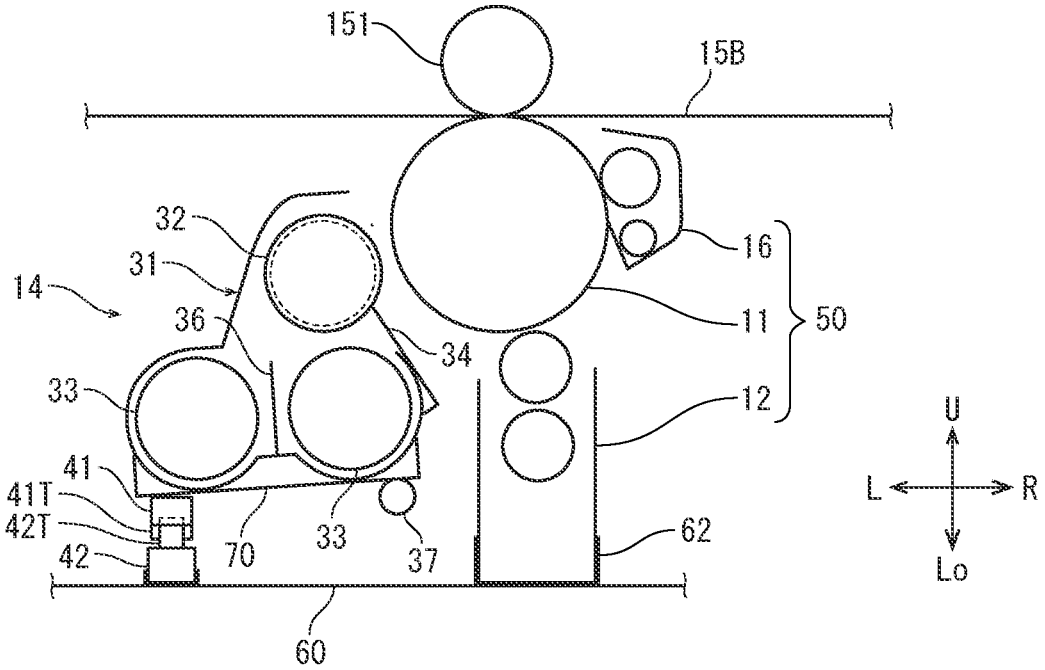
FIG. 8 is a front view schematically showing the structure of the image forming device according to the embodiment of the present disclosure.

Next, the image forming device 6 will be described in detail. FIG. 3 is a perspective view showing the image forming device 6 and an inner cover 3C (in a state where the inner cover 3C is closed). FIG. 4 is a perspective view showing the image forming device 6 and the inner cover 3C (in a state where the inner cover 3C is opened). FIG. 5 is a perspective view showing a drum unit 50. FIG. 6 is a perspective view showing the developing device 14. FIG. 7 and FIG. 8 are front views schematically showing the configuration of the image forming device 6 (excluding the exposure device 13).

[Inner Cover] An opening 3A and an outer cover 3B for closing the opening 3A are provided above the sheet feeding cassette 4 on the front surface of the housing 3 (see FIG. 1). When the opening 3A is opened by opening (or removing) the outer cover 3B, an inner cover 3C (an example of the cover) is exposed (see FIG. 3 and FIG. 4). The lower end portion of the inner cover 3C is coupled to the opening 3A with a hinge 3H whose axial direction is along the left-and-right direction. Four sets of detachable drum units 50 and developing devices 14 are provided behind the inner cover 3C.

[Drum Unit] The drum unit 50 (see FIG. 5 and FIG. 7) is formed by integrating the photosensitive drum 11, the charging device 12 and the cleaning device 16. The lower portion of the drum unit 50 is formed in a box-like shape whose longitudinal direction is along the front-and-rear direction, and the charging device 12 is housed therein. The photosensitive drum 11 is provided above the charging device 12, and the cleaning device 16 is provided on the right side of the photosensitive drum 11.

[Developing Device] The developing device 14 (see FIG. 6 and FIG. 7) includes two screws 33 which rotate around axes to agitate a developer, a developing roller 32 which holds the developer above the screws 33, a housing 31 in which the screws 33 and the developing roller 32 are housed and has an opening 35 through which a part of the outer circumferential surface of the developing roller 32 is exposed, and a blade 34 which is disposed below the opening 35 and regulates a layer thickness of the developer held by the developing roller 32. The developing roller 32 and the screws 33 are disposed with their axial directions along the front-and-rear direction.

The developer is a two-component developer containing a magnetic carrier and a non-magnetic toner, for example. The two screws 33 are disposed inside the housing 31 in parallel with each other in the left-and-right direction, and convey the developer in opposite directions. A partition wall part 36 is provided between the two screws 33. Gaps are provided between the front end portion of the partition wall part 36 and the inner surface of the housing 31, and between the rear end portion of the partition wall part 36 and the inner surface of the housing 31. The developer circulates around the partition wall part 36 through the gaps. The screws 33 agitate the developer to triboelectrically charge the developer.

The developing roller 32 is disposed above the right screw 33 in parallel with the screw 33. The developing roller 32 includes a permanent magnet and a developing sleeve made of non-magnetic material and covering the circumference of the permanent magnet (not shown). A driven gear 32G is provided at the rear end portion of the developing roller 32. The opening 35 is formed on the right side portion of the upper portion of the housing 31, and the outer circumferential surface of the developing roller 32 exposed through the opening 35 faces the outer circumferential surface of the photosensitive drum 11. The developer forms a magnetic brush layer on the surface of the developing roller 32. The tip end of the blade 34 is disposed at a predetermined interval from the developing roller 32, and a layer thickness of the magnetic brush is adjusted to a predetermined thickness.

At both end portions of the developing roller 32, annular gap regulating members 32S having a diameter larger than that of the developing sleeve are provided. When the gap regulating member 32S comes into contact with the outer circumferential surface of the photosensitive drum 11, the outer circumferential surface of the developing sleeve and the outer circumferential surface of the photosensitive drum 11 face each other with a predetermined gap.

Figure 9:
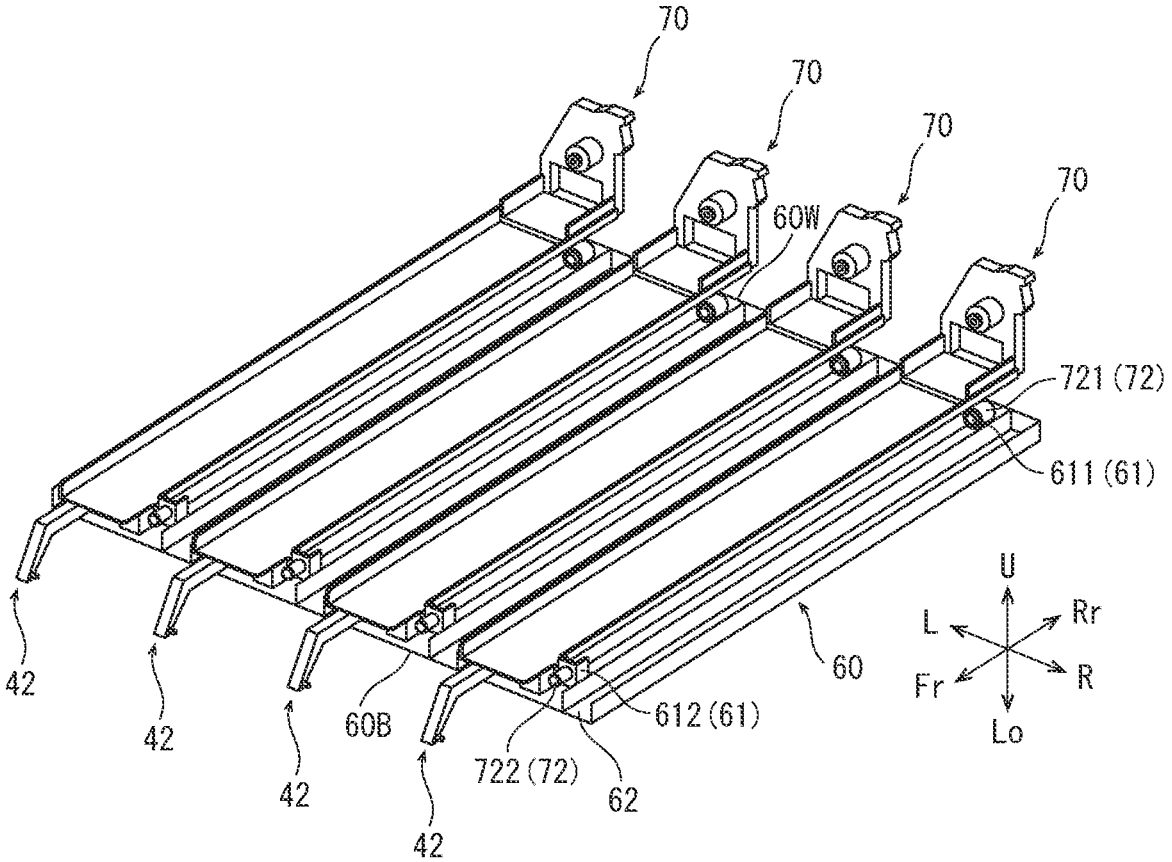
FIG. 9 is a perspective view showing a development holder supported by a unit support frame according to the embodiment of the present disclosure.
Figure 10:
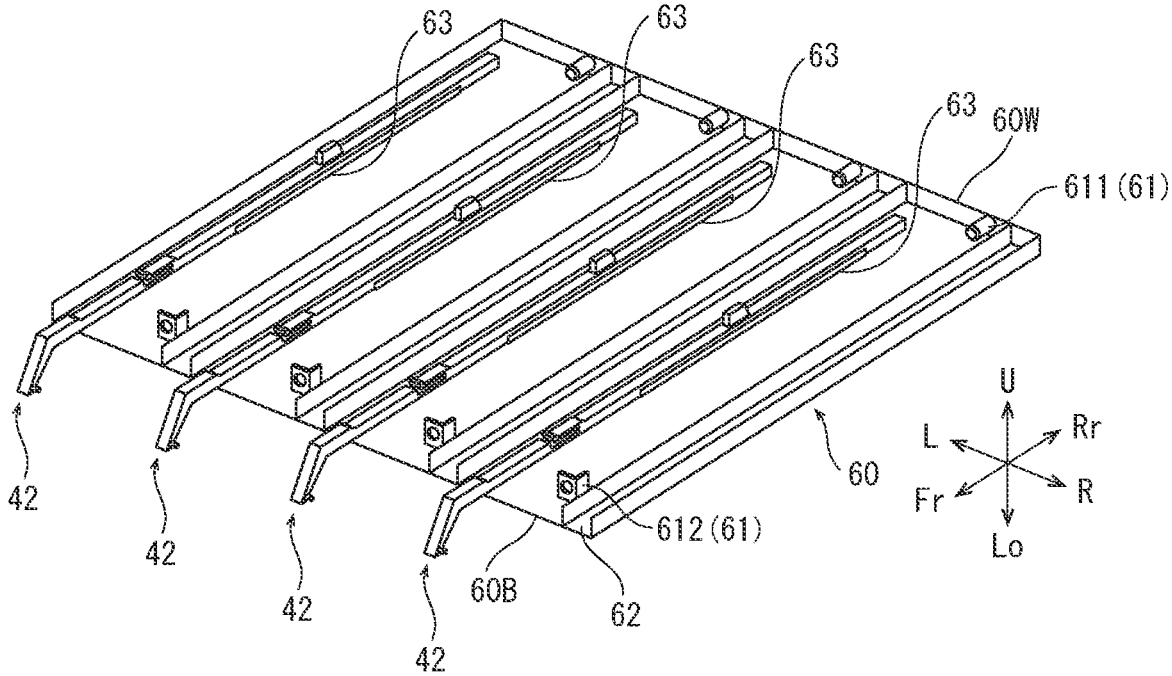
FIG. 10 is a perspective view showing the unit support frame according to the embodiment of the present disclosure.
Figure 11:
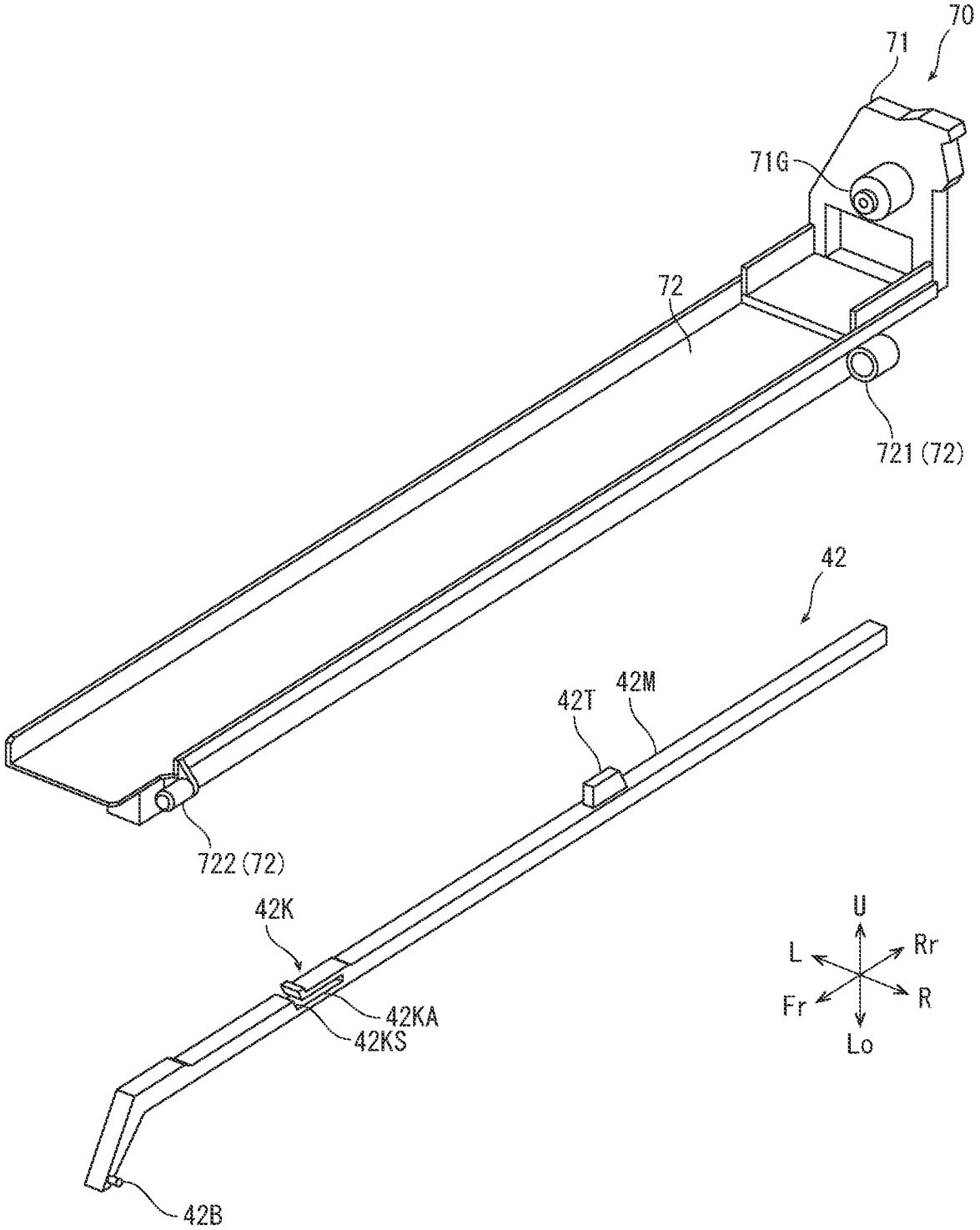
FIG. 11 is a perspective view showing the development holder and a lower rail according to the embodiment of the present disclosure.
Figure 12:
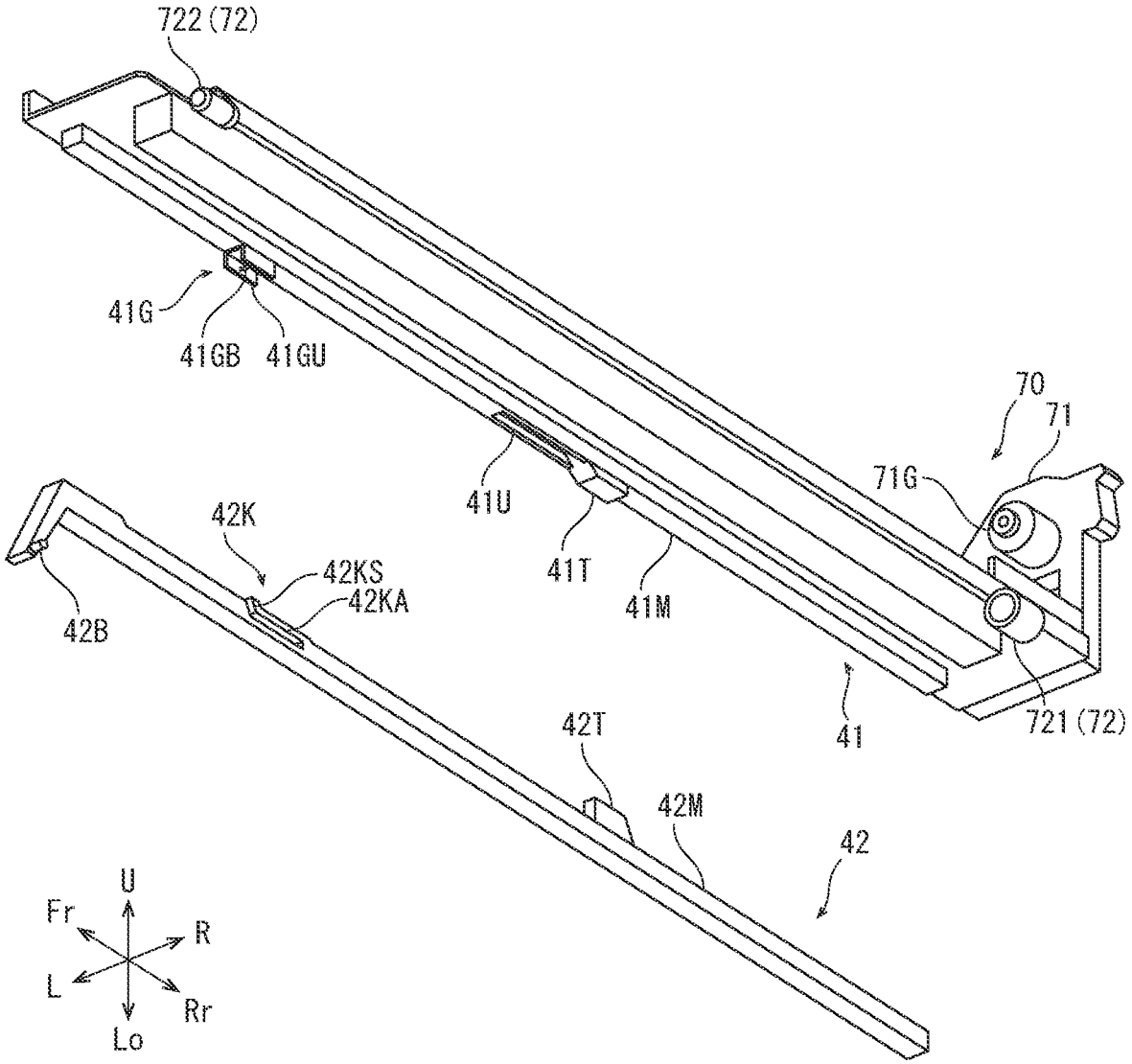
FIG. 12 is a perspective view showing the development holder, an upper rail and the lower rail according to the embodiment of the present disclosure.
Figure 13:
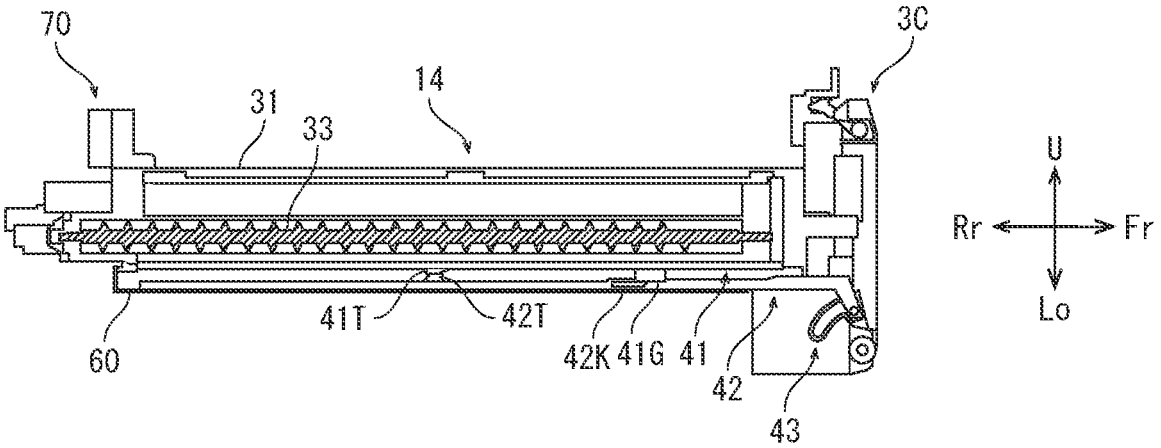
FIG. 13 is a sectional view showing the lower rail and the developing device according to the embodiment of the present disclosure.
Figure 14:
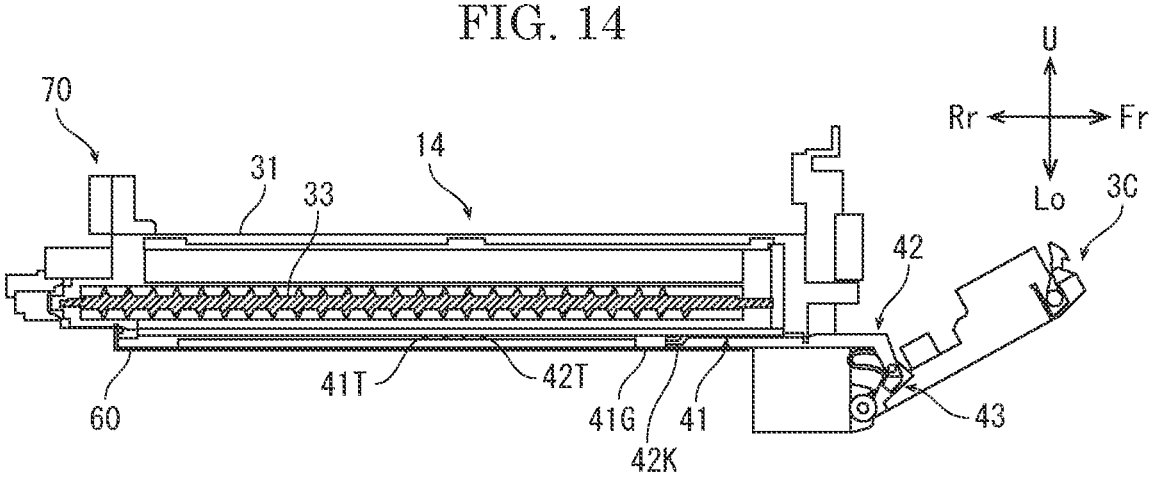
FIG. 14 is a sectional view showing the lower rail and the developing device according to the embodiment of the present disclosure.
Figure 15:
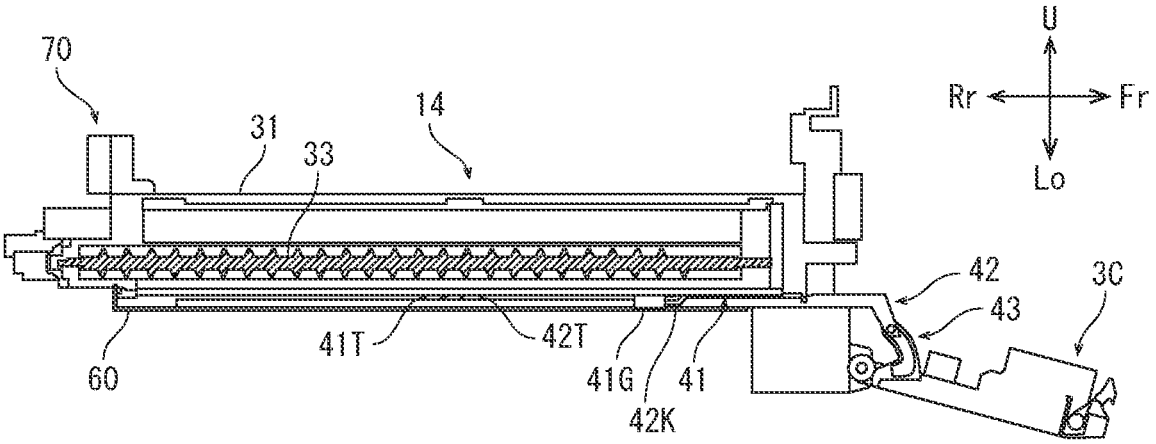
FIG. 15 is a sectional view showing the lower rail and the developing device according to the embodiment of the present disclosure.
Figure 16:
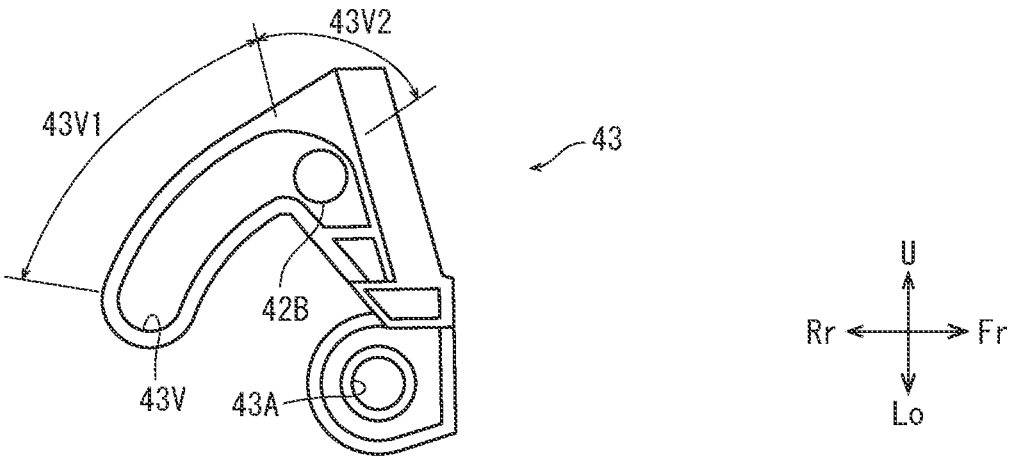
FIG. 16 is a side view showing a link member according to the embodiment of the present disclosure.
Figure 17:
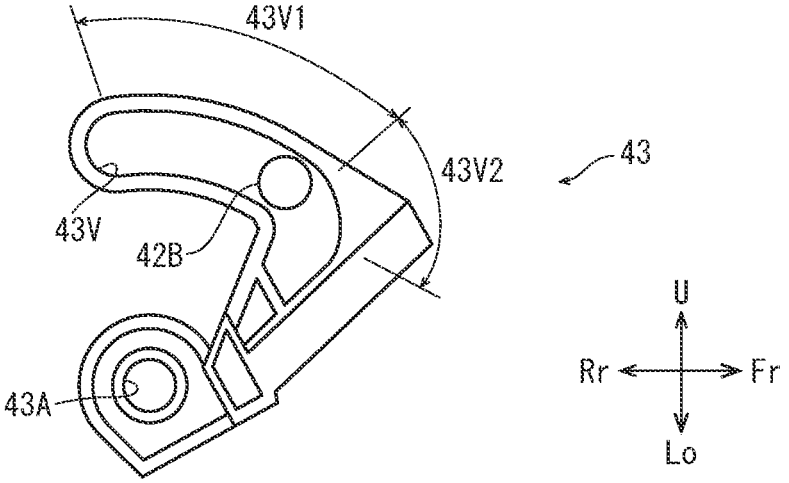
FIG. 17 is a side view showing the link member according to the embodiment of the present disclosure.
Figure 18:
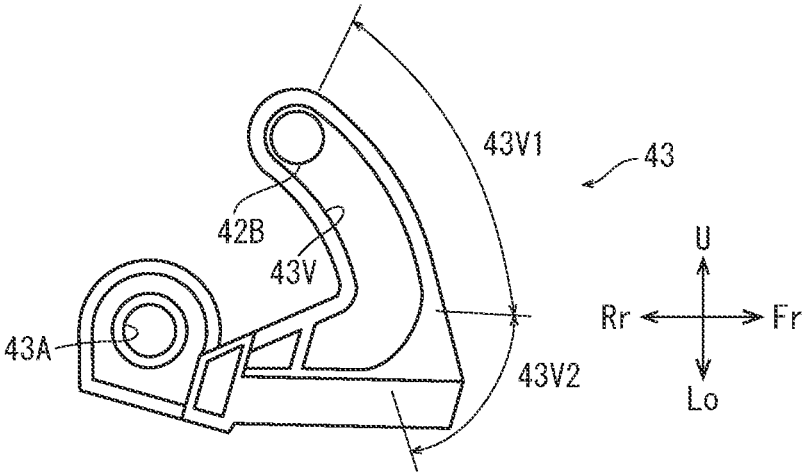
FIG. 18 is a side view showing the link member according to the embodiment of the present disclosure.

Next, a configuration for positioning the developing device 14 will be described. FIG. 9 is a perspective view showing a state in which the development holder 70 is mounted on the unit support frame 60. FIG. 10 is a perspective view showing the unit support frame 60. FIG. 11 is a perspective view showing the development holder 70 and a lower rail 42. FIG. 12 is a perspective view showing the development holder 70, an upper rail 41, and the lower rail 42. FIG. 13 is a sectional view showing the lower rail 42 and the developing device 14 (in a state where the inner cover 3C is fully closed). FIG. 14 is a sectional view showing the lower rail 42 and the developing device 14 (in a state where the inner cover 3C is in a predetermined position between a fully closed position and a fully opened position). FIG. 15 is a sectional view showing the lower rail 42 and the developing device 14 (in a state where the inner cover 3C is fully opened). FIG. 13 to FIG. 15 show cross sections along the axis of the left screw 33. FIG. 16 to FIG. 18 are side views showing a link member 43.

The image forming apparatus 100 includes a drum unit 50 including the photosensitive drum 11; the developing device 14 including the developing roller 32 having an outer circumferential surface disposed so as to face an outer circumferential surface of the photosensitive drum 11; a development holder 70 to which the developing device 14 is detachably attached and which is swung so as to bring and separate the developing roller 32 close to and apart from the photosensitive drum 11; and a lower rail 42 (an example of the sliding member) which is slidable in an axial direction of the developing roller 32. The development holder 70 is swung so as to bring the developing roller 32 close to the photosensitive drum 11 in association with a sliding of the lower rail 42 from a first position to a second position, and the development holder 70 is swung so as to separate the developing roller 32 apart from the photosensitive drum 11 in association with a sliding of the lower rail 42 from the second position to the first position.

[Unit support frame] The unit support frame 60 (see FIG. 9 and FIG. 10) is a member which supports the four sets of the drum units 50 and the developing devices 14. The unit support frame 60 has a substantially rectangular plate-shaped bottom portion 60B, and is fixed to the housing 3. On the upper surface of the unit support frame 60, a drum unit support part 62, a holder support part 61 and a lower rail support part 63 are provided.

The drum unit support part 62 is a recessed portion into which the lower portion of the drum unit 50 is fitted. The development holder 70 which supports the developing device 14 paired with the drum unit 50 is provided on the left side of the drum unit support part 62. The development holder 70 is supported by the holder support part 61. The holder support part 61 has a first fulcrum 611 and a second fulcrum 612 which support the development holder 70 at two positions in the front-and-rear direction. At the rear end portion of the unit support frame 60, an upwardly upright wall portion 60W is provided. The first fulcrum 611 is a cylindrical shaft protruding forward from the wall portion. The second fulcrum 612 is an upright plate-shaped member provided in front of the first fulcrum 611, and has a circular hole penetrating in the front-and-rear direction. A center line of the axis of the first fulcrum 611 passes through a center of the hole of the second fulcrum 612. The lower rail support part 63 is provided on the left side portion of the upper surface of the holder support part 61, and supports the lower rail 42 slidably in the front-and-rear direction by contacting with the left and right side surfaces of the lower rail 42 described later.

[Development Holder] The development holder 70 (see FIG. 11 and FIG. 12) has an axial connection part 71 to which the rear end portion of the developing device 14 is connected, and a bottom support part 72 which supports the bottom portion of the developing device 14. The axial connection part 71 faces the rear end portion of the developing device 14, and has a driving gear 71G. The driving gear 71G is driven by a motor via a reduction gear (not shown). The bottom support part 72 is a generally rectangular plate-shaped member whose longitudinal direction is along the front-and-rear direction, and has a wall portion which regulates a displacement of the developing device 14 in the left-and-right direction.

A first fulcrum 721 and a second fulcrum 722 are provided at the right end portion of the bottom support part 72. The first fulcrum 721 is a circular hole into which the first fulcrum 611 of the unit support frame 60 is fitted. The second fulcrum 722 is a cylindrical shaft fitted to the second fulcrum 612 of the unit support frame 60. A fulcrum 37 is provided at the lower right portion of the front end portion of the housing 31 of the developing device 14. The fulcrum 37 is a hole penetrating in the front-and-rear direction, for example. The fulcrum 37 is externally fitted to the second fulcrum 722 of the development holder 70. The development holder 70 and the developing device 14 can be swung around the first fulcrum 721 and the second fulcrum 722.

The developing device 14 is attached to the development holder 70 by being pushed into the development holder 70 from the front side. At this time, the driven gear 32G of the developing roller 32 is meshed with the driving gear 71G of the development holder 70. The developing device 14 is removed from the development holder 70 by pulling it forward from the development holder 70.

[Upper Rail and Lower Rail] The upper rail 41 and the lower rail 42 (see FIG. 11 to FIG. 15) are rod-shaped members whose longitudinal direction is along the front-and-rear direction. The upper rail 41 is fixed to the left side portion of the lower surface of the development holder 70. As described above, the lower rail 42 is slidably provided on the upper surface of the unit support frame 60. The upper rail 41 and the lower rail 42 face each other in the upper-and-lower direction.

The upper rail 41 has a body portion 41M having a rectangular cross section. On the lower surface of the main body portion 41M, a first convex portion 41T protruding downward is provided at a position slightly rearward of the central portion of the development holder 70 in the front-and-rear direction. The first convex portion 41T has left and right side surfaces, a front surface, a rear surface and a lower surface, and the front surface is inclined such that the upper end portion is positioned in front of the lower end portion. On the front side of the first convex portion 41T, a recess 41U long in the front-and-rear direction is provided adjacent to the first convex portion 41T. The width of the recess 41U in the left-and-right direction is narrower than the width of the first convex portion 41T.

On the lower surface of the upper rail 41, a guide member 41G is provided in front of the recess 41U. The guide member 41G has a groove-shaped member 41GU and a rod-shaped member 41GB whose longitudinal direction is along the left-and-right direction. The groove-shaped member 41GU has a top plate portion, and right and left side wall portions, and the top plate portion is fixed to the lower surface of the upper rail 41. The rod-shaped member 41GB is provided inside the groove-shaped member 41GU, and the left and right end portions of the rod-shaped member 41GB are supported by the left and right side wall portions of the groove-shaped member 41GU.

The lower rail 42 has a body portion 42M having a rectangular cross section. The front end portion of the main body portion 42M has a shape bent downward, and has a boss 42B projecting rightward. On the upper surface of the lower rail 42, a second convex portion 42T protruding upward is provided. The second convex portion 42T has left and right side surfaces, a front surface, a rear surface, and an upper surface, and the rear surface is inclined such that the upper end portion is positioned in front of the lower end portion. The width of the second convex portion 42T in the left-and-right direction is slightly smaller than the width of the recess 41U of the upper rail 41, and the second convex portion 42T can enter the recess 41U.

The lower rail 42 has a notch 42K into which the rod-shaped member 41GB of the guide member 41G of the upper rail 41 can be inserted. The notch 42K has an axial portion 42KA extending in the front-and-rear direction (the axial direction of the developing roller 32) and an inclined portion 42KS inclined similarly to the front surface of the first convex portion 41T and the rear surface of the second convex portion 42T.

[Link Member] The link member 43 (see FIG. 16 to FIG. 18) is fixed to the inside of the inner cover 3C, and is turned together with the inner cover 3C when the inner cover 3C is opened and closed. The link member 43 has an axial hole portion 43A supported coaxially with the hinge 3H of the inner cover 3C, and a groove 43V sliding with respect to the tip end portion of the boss 42B when the inner cover 3C is opened and closed. The groove 43V has an arc-shaped first section 43V1 centering on the axis of the hinge 3H, and a second section 43V2 continuing to the first section 43V1 and having a radius of curvature smaller than that of the first section 43V1. The second section 43V2 is connected to the end of the first section 43V1 on the side of the inner cover 3C.

Next, the opening/closing operation of the inner cover 3C will be described. FIG. 15 and FIG. 18 show a state in which the inner cover 3C is fully opened. The developing device 14 is attached and detached in the state where the inner cover 3C is fully opened. The boss 42B of the lower rail 42 is located at the end of the first section 43V1 of the groove 43V of the link member 43 on the side of the developing device 14. At this time, the lower rail 42 is at the position where it is pulled forward most. This position is called the first position.

In the first position, the second convex portion 42T of the lower rail 42 is positioned in front of the first convex portion 41T of the upper rail 41, and enters the recess 41U of the upper rail 41. That is, the second convex portion 42T is not in contact with the first convex portion 41T. The rod-shaped member 41GB of the guide member 41G of the upper rail 41 is positioned at the axial portion 42KA of the notch 42K of the lower rail 42. At this time, the upper rail 41 is closest to the lower rail 42, and the developing roller 32 is furthest away from the photosensitive drum 11, as shown in FIG. 8.

FIG. 14 and FIG. 17 show a state in which the boss 42B is located near the boundary between the first section 43V1 and the second section 43V2 of the groove 43V. The position of the inner cover 3C at this time is called a predetermined position. When the inner cover 3C is turned within a range from the fully opened position to the predetermined position, the first section 43V1 slides with respect to the boss 42B while the lower rail 42 remains in the first position. Since the lower rail 42 does not move, the relative positional relationship with the upper rail 41 does not change, and the posture of the development holder 70 does not change.

FIG. 13 and FIG. 16 show a state in which the inner cover 3C is fully closed. When the inner cover 3C is closed from the predetermined position to the fully closed position, since the boss 42B enters the second section 43V2 of the groove 43V, the boss 42B is pushed backward by the outer circumference of the second section 43V2, and the lower rail 42 also moves backward. When the inner cover 3C is fully closed, the lower rail 42 is at the position where it is pushed rearward most. This position is called the second position.

When the lower rail 42 moves from the first position (see FIG. 15) to the second position (see FIG. 13), the rear surface of the second convex portion 42T moves rearward while sliding relative to the front surface of the first convex portion 41T. The rod-shaped member 41GB of the guide member 41G of the upper rail 41 moves backward while sliding with respect to the inclined portion 42KS of the notch 42K of the lower rail 42. Therefore, the upper rail 41 is gradually pushed up, the lower surface of the first convex portion 41T runs on the upper surface of the second convex portion 42T, and the rod-shaped member 41GB runs on the upper surface of the lower rail 42. At this time, the upper rail 41 is most separated from the lower rail 42, and the developing roller 32 is closest to the photosensitive drum 11, as shown in FIG. 7.

When the inner cover 3C is opened from the fully closed position (see FIG. 13) to the predetermined position (see FIG. 14), the boss 42B is pushed forward by the inner circumference of the second section 43V2 of the groove 43V, and the lower rail 42 also moves forward. When the inner cover 3C reaches the predetermined position, the lower rail 42 reaches the first position. When the lower rail 42 moves from the second position to the first position, the rear surface of the second convex portion 421 moves forward while sliding with respect to the front surface of the first convex portion 411. The rod-shaped member 41GB moves forward while sliding with respect to the inclined portion 42KS of the notch 42K. Therefore, the upper rail 41 gradually lowers and returns to the fully opened position (see FIG. 15).

The image forming apparatus 100 according to the embodiment described above includes the drum unit 50 including the photosensitive drum 11; the developing device 14 including the developing roller 32 having an outer circumferential surface disposed so as to face an outer circumferential surface of the photosensitive drum 11; the development holder 70 to which the developing device 14 is detachably attached and which is swung so as to bring and separate the developing roller 32 close to and apart from the photosensitive drum 11; and the lower rail 42 (an example of the sliding member) which is slidable in an axial direction of the developing roller 32. The development holder 70 is swung so as to bring the developing roller 32 close to the photosensitive drum 11 in association with a sliding of the lower rail 42 from a first position to a second position, and the development holder 70 is swung so as to separate the developing roller 32 apart from the photosensitive drum 11 in association with a sliding of the lower rail 42 from the second position to the first position. Therefore, the positioning of the developing device 14 can be easily and surely performed with a simple structure.

Further, according to the image forming apparatus 100 of the present embodiment, the lower rail 42 is provided below the development holder 70, the development holder 70 has the first convex portion 41T protruding downward, and the lower rail 42 has the second convex portion 42T protruding upward. When the lower rail 42 is positioned in the first position, the first convex portion 41T is not brought into contact with the second convex portion 42T. When the lower rail 42 slides from the first position to the second position, the first convex portion 41T pushes the second convex portion 42T away, so that the development holder 70 is swung so as to bring the developing roller 32 close to the photosensitive drum 11. Therefore, it becomes possible to swing the development holder 70 in association with the sliding of the lower rail 42 with a simple structure.

Further, according to the image forming apparatus 100 of the present embodiment, there are provided the opening 3A into which the developing device 14 is inserted, and the inner cover 3C (an example of the cover) connected to the opening 3A with the hinge 3H and to which the lower rail 42 is connected. The lower rail 42 slides from the first position to the second position in association with the operation of closing the inner cover 3C, and the lower rail 42 slides from the second position to the first position in association with the operation of opening the inner cover 3C. Therefore, the positioning of the developing device 14 can be easily and accurately performed only by opening and closing the inner cover 3C.

According to the image forming apparatus 100 according to the present embodiment, there are provided the boss 42B protruding from the end portion of the lower rail 42 on the side of the inner cover 3C in the axial direction of the hinge 3H, the link member 43 provided inside the inner cover 3C and turned together with the inner cover 3C when the inner cover 3C is opened/closed, and the groove 43V provided in the link member 43 and sliding against the tip end portion of the boss 42B when the inner cover 3C is opened/closed. The groove 43V has the first section 43V1 having an arc shape around the axis of the hinge 3H, and the second section 43V2 continuous with the end of the first section 43V1 on the side of the inner cover 3C and having a radius of curvature smaller than that of the first section 43V1. When the inner cover 3C is turned within a range from the fully opened position to the predetermined position between the fully opened position and the fully closed position, the first section 43V1 slides with respect to the boss 42B while the lower rail 42 remains in the first position, and when the inner cover 3C is turned within a range from the predetermined position to the fully closed position, the second section 43V2 slides with respect to the boss 42B, so that the lower rail 42 slides between the first position and the second position. Therefore, since the lower rail 42 is slid in a state where the axial component of the force for opening and closing the inner cover 3C is large, the labor for opening and closing the inner cover 3C can be reduced.

The above embodiment may be modified as follows.

In the above embodiment, the rear surface of the second convex portion 42T slides with respect to the front surface of the first convex portion 41T, but the rear end portion of the lower rail 42 may be inclined in the same manner as the rear surface of the second convex portion 42T, and the rear end portion of the lower rail 42 may slide with respect to the front surface of the first convex portion 41T. In this case, the second convex portion 42T is unnecessary. This configuration also realizes the same function as that of the above-described embodiment.

In the above embodiment, the first convex portion 41T is provided on the lower surface of the upper rail 41, but the first convex portion 41T may be provided on the lower surface of the development holder 70 without providing the upper rail 41. This configuration also realizes the same function as that of the above-described embodiment.

In the above embodiment, the link member 43 has the axial hole portion 43A supported coaxially with the hinge 3H of the inner cover 3C, but the link member 43 may not be provided with the axial hole portion 43A. This configuration also realizes the same function as that of the above-described embodiment. The inner cover 3C can be prevented from being deformed during opening and closing if the axial hole portion 43A is provided.

In the above embodiment, the inner cover 3C is provided behind the outer cover 3B, but the outer cover 3B may also serve as the inner cover 3C.

The invention claimed is:

1. An image forming apparatus comprising:

a drum unit including a photosensitive drum;

a developing device including a developing roller disposed such that its outer circumferential surface faces an outer circumferential surface of the photosensitive drum;

a development holder to which the developing device is detachably attached and which is swung around a fulcrum which is disposed below an end portion of the development holder on a side closer to the photosensitive drum so as to bring and separate the developing roller close to and apart from the photosensitive drum; and a sliding member which is slidable in an axial direction of the developing roller, wherein the development holder is swung around the fulcrum so as to bring the developing roller close to the photosensitive drum in association with a sliding of the sliding member from a first position to a second position, and the development holder is swung around the fulcrum so as to separate the developing roller apart from the photosensitive drum in association with a sliding of the sliding member from the second position to the first position.

2. The image forming apparatus according to claim 1, wherein the sliding member is provided below the development holder, the development holder has a first convex portion protruding downward, the sliding member has a second convex portion protruding upward, the first convex portion is not in contact with the second convex portion when the sliding member is in the first position, and the first convex portion pushes the second convex portion upward to swing the development holder so as to bring the developing roller close to the photosensitive drum when the sliding member is slid from the first position to the second position.

3. The image forming apparatus according to claim 1, further comprising:

an opening through which the developing device is inserted; and a cover coupled to the opening with a hinge and connected to the sliding member, wherein the sliding member is slid from the first position to the second position in association with an operation for closing the cover, and the sliding member is slid from the second position to the first position in association with an operation for opening the cover.

4. The image forming apparatus according to claim 3, further comprising:

a boss protruding in an axial direction of the hinge from an end portion of the sliding member on a side of the cover;

a link member provided inside the cover and turning together with the cover when the cover is opened and closed; and a groove provided in the link member and slid with respect to a tip end portion of the boss when the cover is opened and closed, wherein the groove has:

a first section having an arc shape around an axis of the hinge; and a second section continuous to an end portion of the first section on a side of the cover and having a radius of curvature smaller than that of the first section, when the cover is turned within a range from a fully opened position to a predetermined position between the fully opened position and a fully closed position, the first section slides with respect to the boss while the sliding member remains in the first position, and when the cover is turned within a range from the predetermined position to the fully closed position, the second section slides with respect to the boss, so that the sliding member slides between the first position and the second position.

5. The image forming apparatus according to claim 4, wherein the link member is fixed to the inside of the cover and is turned around the hinge.

6. An image forming apparatus comprising:

a drum unit including a photosensitive drum;

a developing device including a developing roller disposed such that its outer circumferential surface faces an outer circumferential surface of the photosensitive drum;

a development holder to which the developing device is detachably attached and which is swung so as to bring and separate the developing roller close to and apart from the photosensitive drum; and a sliding member which is provided below the development holder and slidable in an axial direction of the developing roller, wherein the development holder is swung so as to bring the developing roller close to the photosensitive drum in association with a sliding of the sliding member from a first position to a second position, and the development holder is swung so as to separate the developing roller apart from the photosensitive drum in association with a sliding of the sliding member from the second position to the first position, wherein the development holder has a first convex portion protruding downward, the sliding member has a second convex portion protruding upward, the first convex portion is not in contact with the second convex portion when the sliding member is in the first position, and the first convex portion pushes the second convex portion upward to swing the development holder so as to bring the developing roller close to the photosensitive drum when the sliding member is slid from the first position to the second position.

7. An image forming apparatus comprising:

a drum unit including a photosensitive drum;

a developing device including a developing roller disposed such that its outer circumferential surface faces an outer circumferential surface of the photosensitive drum;

a development holder to which the developing device is detachably attached and which is swung so as to bring and separate the developing roller close to and apart from the photosensitive drum;

a sliding member which is slidable in an axial direction of the developing roller;

an opening through which the developing device is inserted;

a cover coupled to the opening with a hinge and connected to the sliding member;

a boss protruding in an axial direction of the hinge from an end portion of the sliding member on a side of the cover;

a link member provided inside the cover and turning together with the cover when the cover is opened and closed; and a groove provided in the link member and slid with respect to a tip end portion of the boss when the cover is opened and closed, wherein the sliding member is slid from a first position to a second position in association with an operation for closing the cover, and the sliding member is slid from the second position to the first position in association with an operation for opening the cover, the development holder is swung so as to bring the developing roller close to the photosensitive drum in association with a sliding of the sliding member from the first position to the second position, and the groove has:

a first section having an arc shape around an axis of the hinge; and a second section continuous to an end portion of the first section on a side of the cover and having a radius of curvature smaller than that of the first section, when the cover is turned within a range from a fully opened position to a predetermined position between the fully opened position and a fully closed position, the first section slides with respect to the boss while the sliding member remains in the first position, when the cover is turned within a range from the predetermined position to the fully closed position, the second section slides with respect to the boss, so that the sliding member slides between the first position and the second position, and the development holder is swung so as to separate the developing roller apart from the photosensitive drum in association with a sliding of the sliding member from the second position to the first position.

8. The image forming apparatus according to claim 7, wherein the link member is fixed to the inside of the cover and is turned around the hinge.

* * * * *